US009330562B2

(12) United States Patent
Fox

(10) Patent No.: US 9,330,562 B2
(45) Date of Patent: May 3, 2016

(54) LOCAL WIRELESS NETWORK REMOTE CONTROL OF ANCILLARY RAILWAY IMPLEMENTS

(71) Applicant: Railway Equipment Company, Inc., Minneapolis, MN (US)

(72) Inventor: David Fox, Wayzata, MN (US)

(73) Assignee: Railway Equipment Company, Inc., Minneapolis, MN (US)

( * ) Notice: Subject to any disclaimer, the term of this patent is extended or adjusted under 35 U.S.C. 154(b) by 171 days.

(21) Appl. No.: 14/059,672

(22) Filed: Oct. 22, 2013

(65) Prior Publication Data

US 2014/0111321 A1 Apr. 24, 2014

Related U.S. Application Data

(60) Provisional application No. 61/716,979, filed on Oct. 22, 2012.

(51) Int. Cl.

| | |
|---|---|
| ***B61L 7/08*** | (2006.01) |
| ***G08C 17/02*** | (2006.01) |
| ***B61L 27/00*** | (2006.01) |
| *B61L 3/12* | (2006.01) |

(52) U.S. Cl.

CPC ..... *G08C 17/02* (2013.01); *B61L 27/0088* (2013.01); *B61L 3/127* (2013.01); *B61L 7/08* (2013.01); *B61L 27/0005* (2013.01); *B61L 27/0077* (2013.01); *G08C 2201/93* (2013.01)

(58) Field of Classification Search

CPC ..... B61L 3/127; B61L 7/00; B61L 7/06; B61L 27/0061; B08C 17/02; G08C 2201/93

USPC ..... 246/165, 428; 340/12.22, 12.54; 701/2, 701/19

See application file for complete search history.

(56) References Cited

U.S. PATENT DOCUMENTS

| | | | | |
|---|---|---|---|---|
| 6,135,396 | A * | 10/2000 | Whitfield et al. | 246/182 R |
| 6,995,666 | B1 * | 2/2006 | Luttrell | 340/539.1 |
| 7,274,305 | B1 * | 9/2007 | Luttrell | B61L 1/20 324/141 |
| 2012/0091288 | A1 * | 4/2012 | Rosetti | B61L 27/0088 246/415 R |

* cited by examiner

*Primary Examiner* — Steven Lim
*Assistant Examiner* — Benyam Haile
(74) *Attorney, Agent, or Firm* — Schwegman Lundberg & Woessner, P.A.

(57) ABSTRACT

Systems and methods for local wireless network remote control of ancillary railway implements are described herein. In one implementation, a portable computing module uses a wireless module to control an ancillary railway implement. In one implementation, the portable computing module connects through ancillary railway implement to control one or more nodes, where the nodes are additional ancillary railway implements.

14 Claims, 7 Drawing Sheets

LOCAL WIRELESS NETWORK REMOTE CONTROL OF ANCILLARY RAILWAY IMPLEMENTS

CLAIM OF PRIORITY

This patent application claims the benefit of priority, under 35 U.S.C. Section 119(e), to U.S. Provisional Patent Application Ser. No. 61/716,979, filed on Oct. 22, 2012, which is incorporated by reference herein in its entirety.

TECHNICAL FIELD

The present subject matter relates, in general, to controlling railway implements, and in particular, to local wireless network remote control of ancillary railway implements.

BACKGROUND

Railroad support personnel expend considerable resources in operating, monitoring, and troubleshooting individual railway implements, such as switch heaters. Conventional railroad switch heaters include hot air blowers or electric heaters. Hot air blowers typically operate on propane, natural gas, electricity, and other energy sources and blow hot air at high speed on to or otherwise heat rail switches to melt snow and ice. Currently, most railroad switch heaters and other railroad implements are controlled through manipulation of control physically coupled to the implements under control. Additionally, railway right of ways, in addition to rail lines, include buried cables that pose difficulties when additional cabling to control various rail implements is needed. Such implements may include not only railway switch heaters, but also signal lights, crossing gates, and other such railway implements.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to reference like features and components.

DETAILED DESCRIPTION OF THE DRAWINGS

The subject matter described herein relates to a local wireless railway ancillary implement network and interface through which various ancillary implements may be controlled and from which data may be obtained. Such systems and methods as described herein may be implemented in a variety of computing environments, such as in a mobile computing environment and on a plurality of computing devices such as a server, a desktop personal computer, a notebook or a portable computer, smartphone, or a mainframe computer.

Conventionally, controls for railway implements are within an enclosure in close proximity to railway implement being controlled, such as an enclosure physically coupled to a railway switch heater. This requires railroad support personnel to manipulate each railway implement manually at each implement location to perform maintenance and operational tasks. Railway implement systems are usually located close to each railway implement, often in a standalone, weather-resistant electrical box. When such systems are in need of service, there is typically snow and ice to wade through to reach the control panels. Further, such control panels are typically in rather close proximity to operating rail lines, which poses extreme safety issues for workers.

As an example, railway implements may include railroad Switch Heater Controls (SHCs), which may control either hot air switch heaters or electric switch heaters. Hot air switch heaters have a single SHC associated with each heater, and electric switch heaters have a single SHC hard-wired to control one or more electric switch heaters, such as up to six electric switch heaters in some embodiments. To monitor or operate the SHC, railroad service personnel usually travel to the SHC box, exit the transportation vehicle, and open the SHC electrical box to perform direct monitoring or control operations. Because heater operation and maintenance is most commonly required during cold, snowy, and icy weather conditions, direct monitoring or control exposes the SHC to harsh weather conditions. In addition to SHCs, railway implements may include railroad crossing gates, railroad crossing warning lights, hot-box detection systems, and the like. To this end, systems and methods for remotely connecting to and operating, monitoring, and troubleshooting railroad implement controllers and implements are described.

Figure 1:
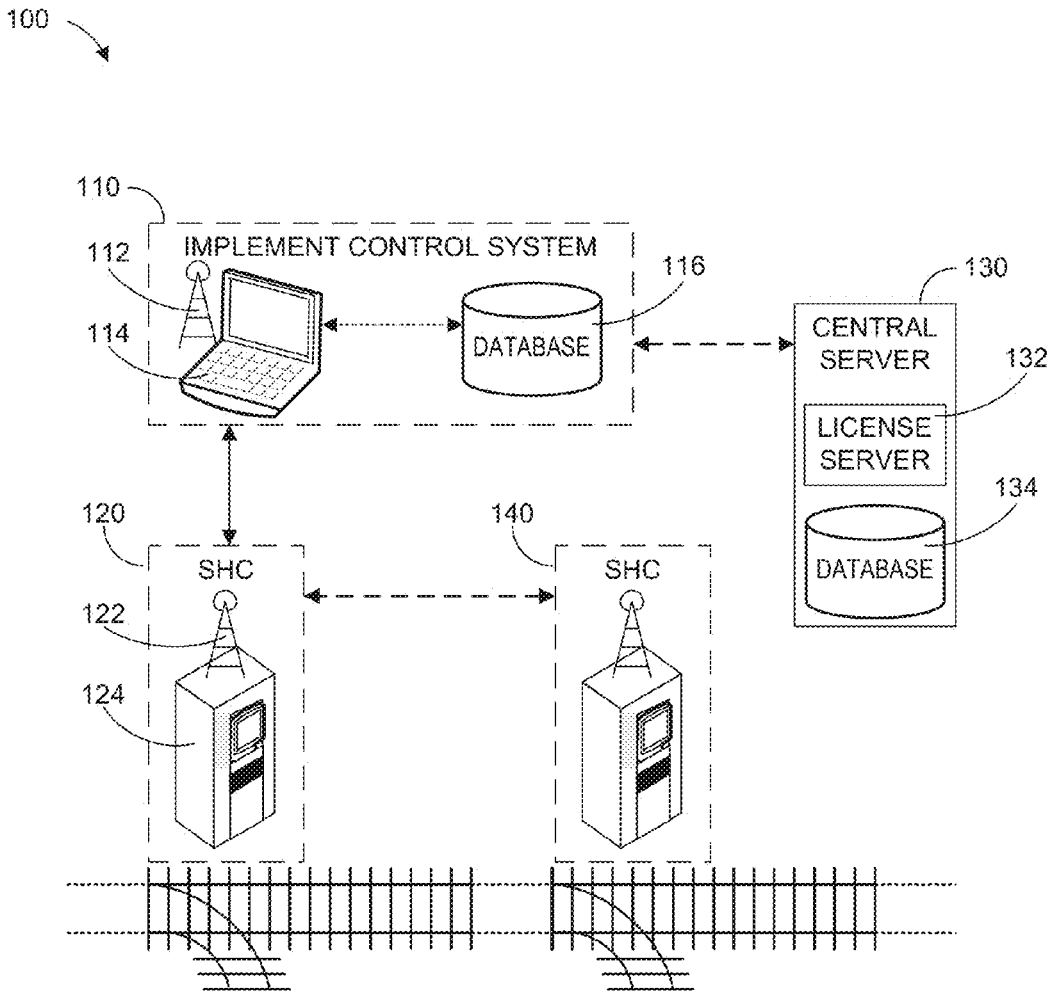
FIG. 1 illustrates a wireless railroad switch heater network, according to one example embodiment according to one example embodiment.

FIG. 1 illustrates a wireless railroad switch heater network 100. The wireless railroad switch heater network 100 may include a portable railway implement control system 110 and at least one SHC system 120. In an implementation, an SHC system 120 may use a wireless radio and antenna 122 attached to the SHC 124 for monitoring or controlling the SHC system 120. Using a wireless network, railroad service personnel are able to drive within wireless range of an SHC system 120, and use a slave RF device 114 connected to or embedded within a portable PC 112 to interface with one or more SHC systems 120. The portable railway implement control system 110 may also be implemented as any other type of computing device (e.g., a tablet, mobile phone, etc.) that includes an embedded RF device or is connectable to the slave RF device 114. In an example, an SHC may have an RF device, either integrated into the SHC circuit board or connected to the SHC as an add-on module. Though conventional electric switch heaters have a single SHC hard-wired to control one or more electric switch heaters, such as up to six electric switch heaters, the hard-wired connection may be replaced by a RF device. Railroad service personnel may connect wirelessly to a single SHC, and wirelessly control one or more switch heaters associated with that SHC.

In an example, the portable control system 110 may be matched to one or more SHC systems 120 through Media Access Control (MAC) address filtering. Each portable control system 110 or SHC system 120 may be assigned a unique MAC address. MAC address filtering allows the portable control system 110 to permit or deny access to specific SHC systems 120, or allows an SHC system 120 to permit or deny access to specific control systems 110.

In an example, a license system may permit or deny access to specific SHC systems 120, or permit or deny access to specific functionality. In an example, a license server 132 may provide licenses to allow railroad support personnel to monitor or control specific SHC systems 120. The license server 132 may be located within a central server 130. The central server 130 may be located at a railroad support personnel office, be maintained by a manufacturer of the SHC systems 120, or may be contacted wirelessly using the portable control system 110. In an example, railroad support personnel may use an application to connect to a license server 132. For example, the application may request or purchase a license to communicate with one or more specific SHC systems 120, or to use certain functionality within the SHC systems 120. Licenses may be associated with a specific SHC using a MAC address or other identification of the specific SHC. In an example, the system may include a service-oriented license. The service-oriented license may permit railroad support personnel to view or retrieve SHC data in graphical or tabular format, but may prevent railroad support personnel from operating the SHC. In an example, the system may include a functionality-oriented license. The functionality-oriented license may permit or deny performance of certain operations by railroad support personnel.

SHC data may include sensed or measured data stored on a device. Railroad support personnel may collect data using a background process. Railroad support personnel may store the data locally on a control database 116, or may upload the data to a central server 130. The central server 130 may aggregate information from one or more local databases 116 into a central database 134. In an example, data collected at an SHC location may include metadata. Such metadata may include information about when the data was collected, information about which SHC systems 120 provided the data, which sensor of an SHC system 120 collected the data, and other such data.

In an example, the network is a mesh network. For example, the mesh network may be comprised of communication devices that communicate according to the 802.15 communication standard, or other suitable communication standard, protocol, and the like. The mesh network may be comprised of nodes. Each mesh network node may send and receive its own data, and each node may serve as a relay for other nodes. In an example, a node may be any device with wireless communication functionality to bridge two other nodes. A node may be an ancillary railway implement (e.g., SHC, a crossing gate controller, etc.) with wireless communication functionality coupled to or embedded within their control circuitry.

In an example, licenses may be used on the mesh network to permit or deny access to specific nodes. In an example, licenses may be application instance specific, and may permit or deny an application from communicating with an SHC controller. For example, the license may deny an application from communicating with a specific SHC controller, but may allow that SHC controller to be used as a node to relay data. Additionally, if a node includes a wireless circuit that is mesh compliant, in some embodiments, the wireless circuit of an unlicensed controller may still relay data.

In an example, the railroad support personnel may open an application on a portable PC, and the application may identify licensed nodes. For example, instead of railroad support personnel being restricted to monitoring and controlling only the licensed nodes within the wireless range of a single device, controlling nodes via a mesh network allows railroad support personnel to monitor and control other licensed nodes on the mesh network.

In an example, an SHC may provide a mesh network connection to other SHC nodes, allowing railroad support personnel to monitor or control other SHC systems 120. For example, SHC systems 120 may continually monitor and aggregate information from other SHC system nodes 140 on the network. From a single SHC, railroad support personnel may monitor or control all SHC system nodes 140 on the network.

In an example, the wireless communication may be encrypted with AES 128-bit encryption. The wireless communication optionally may use shared-key encryption, or symmetric encryption. In one implementation, individual encryption keys may be used for each SHC to prevent unintentional or unauthorized access. In an example, the encryption keys may be mutually exclusive, and may require railroad support personnel to return to the railroad support personnel office to upload previous SHC data before retrieving a new encryption key. In an example, the data may be encrypted into packets before transmission, or the data may be encrypted before being arranged into packets. In another example, a software license may be used to prevent unintentional or unauthorized access to the PC control program, and an RF device may include a method of authentication specific to one or more SHC systems 120.

Figure 2:
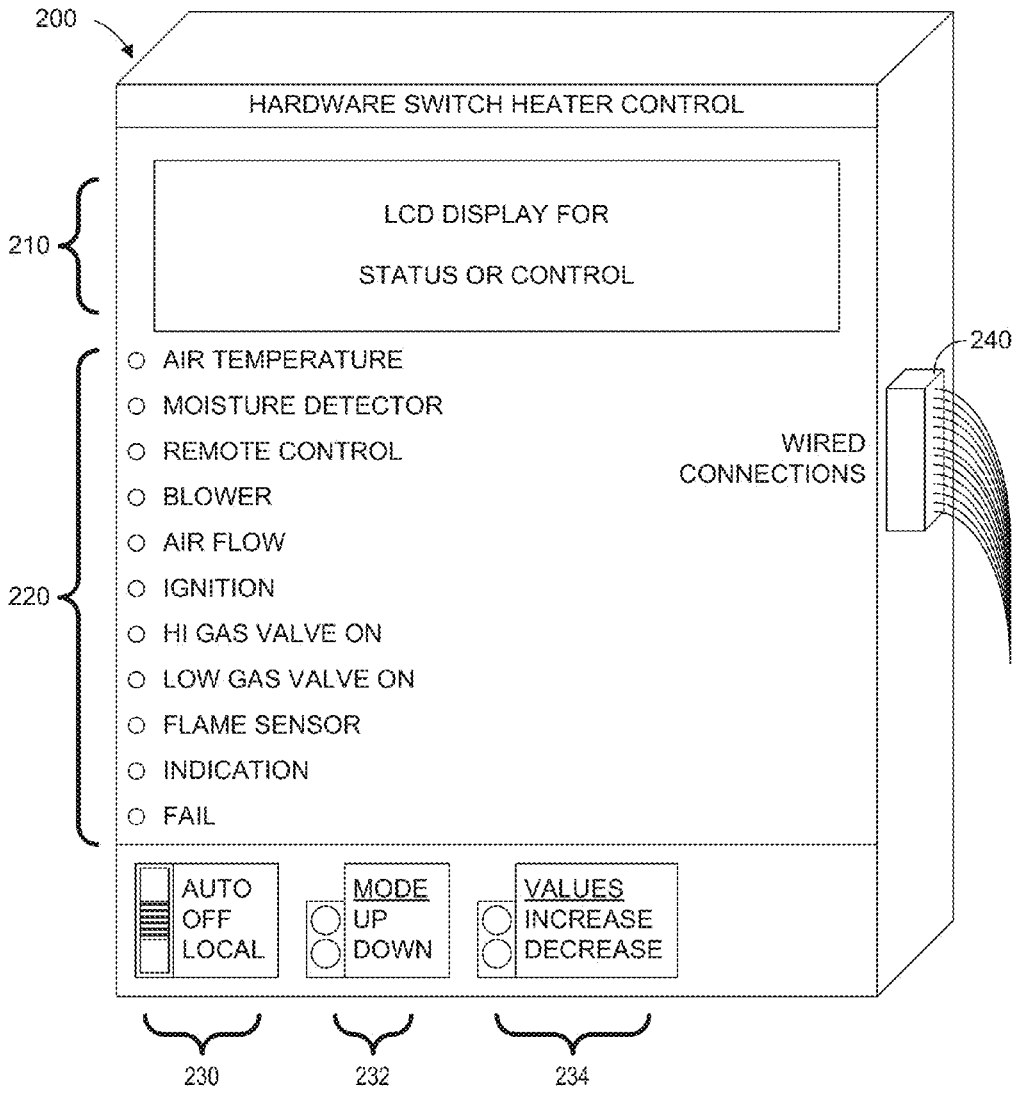
FIG. 2 illustrates a hardware Switch Heater Control interface, according to one example embodiment.

FIG. 2 illustrates a hardware Switch Heater Control interface 200, according to one example embodiment. An SHC interface 200 may include a two-line display 210 or a series of lights 220 to indicate whether each step in the startup process has occurred. An SHC interface 200 may include a control switch 230 to turn the SHC interface 200 off, to run in an automated mode, or to allow for local control. When the control switch 230 is switched to local control, mode buttons 232 may be used to select modes, and value buttons 234 may be used to increase or decrease values. An SHC interface 200 may also include a wire harness 240 for one or more input or output wired connections. For example, the wired connections may include one or more connections for duct pressure, gas pressure, a railroad terminal, an initiation transformer, gas, a sail switch, communication power, 115 volts AC, a transformer, a blower motor, a machine ID, communication lines, a flame control, lights, an over-temperature sensor, a buzzer, an ambient temperature sensor, a rail temperature, or a current coil.

Railroad service personnel may use the SHC to turn the switch heater on or off, to check the heater fuel levels, to monitor the rail temperature, or to perform other monitoring or heater control operations. The portable control system 110 may include an application to control one or more SHC systems 120. The SHC control application may present a list of SHC systems 120 the application of PC system 110 is licensed to communicate with and are within wireless communication in range of the PC system 110. When an SHC system 120 is selected within the SHC control application, the PC system 110 may verify the presence and scope of a license to monitor or control the selected SHC system 120. Following verification of the license, the PC system 110 may then connect to the SHC system 120 for monitoring or control.

Figure 3:
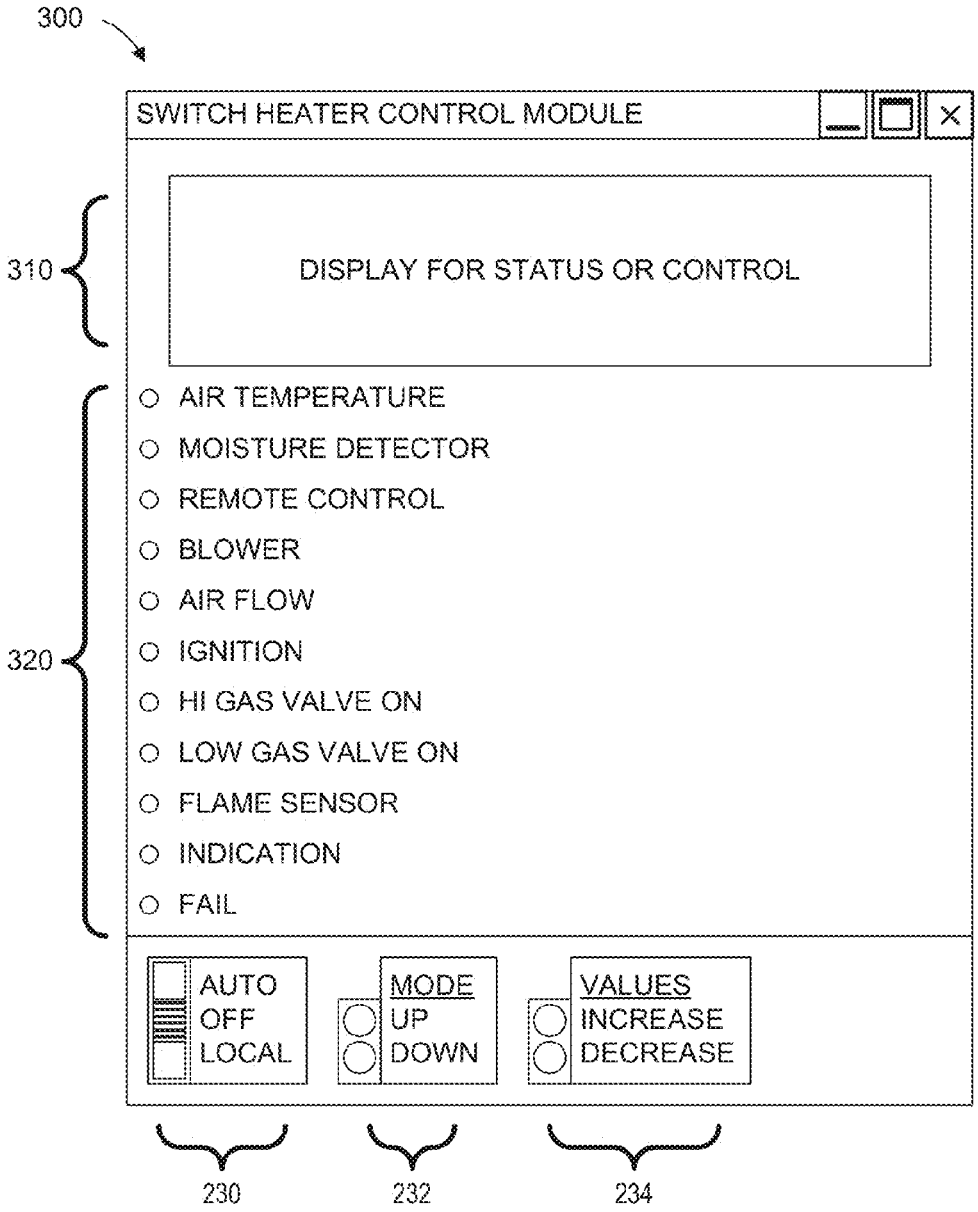
FIG. 3 illustrates a software Switch Heater Control interface application implemented in an electronic device, according to one example embodiment.

FIG. 3 illustrates software Switch Heater Control interface application 300 implemented in an electronic device, according to one example embodiment. For a given SHC interface application 300, the interface may resemble the SHC interface 200. The PC SHC interface may include a display window or a series of status lights, and the status lights may indicate various status information such as whether each step in a startup process has occurred, occurrence of an error or fault, presence or lack of an adequate power supply, low fuel, and the like. Analogous to the SHC interface 200, the SHC interface application 300 may include a two-line display 310 or a series of lights 320 to indicate whether each step in the startup process has occurred. An SHC interface application 300 may include a software control switch 330 to turn the SHC interface application 300 off, to run in an automated mode, or to allow for local control. When the software control switch 330 is switched to local control, software mode buttons 332 may be used to select modes, and software value buttons 334 may be used to increase or decrease values.

Figure 4:
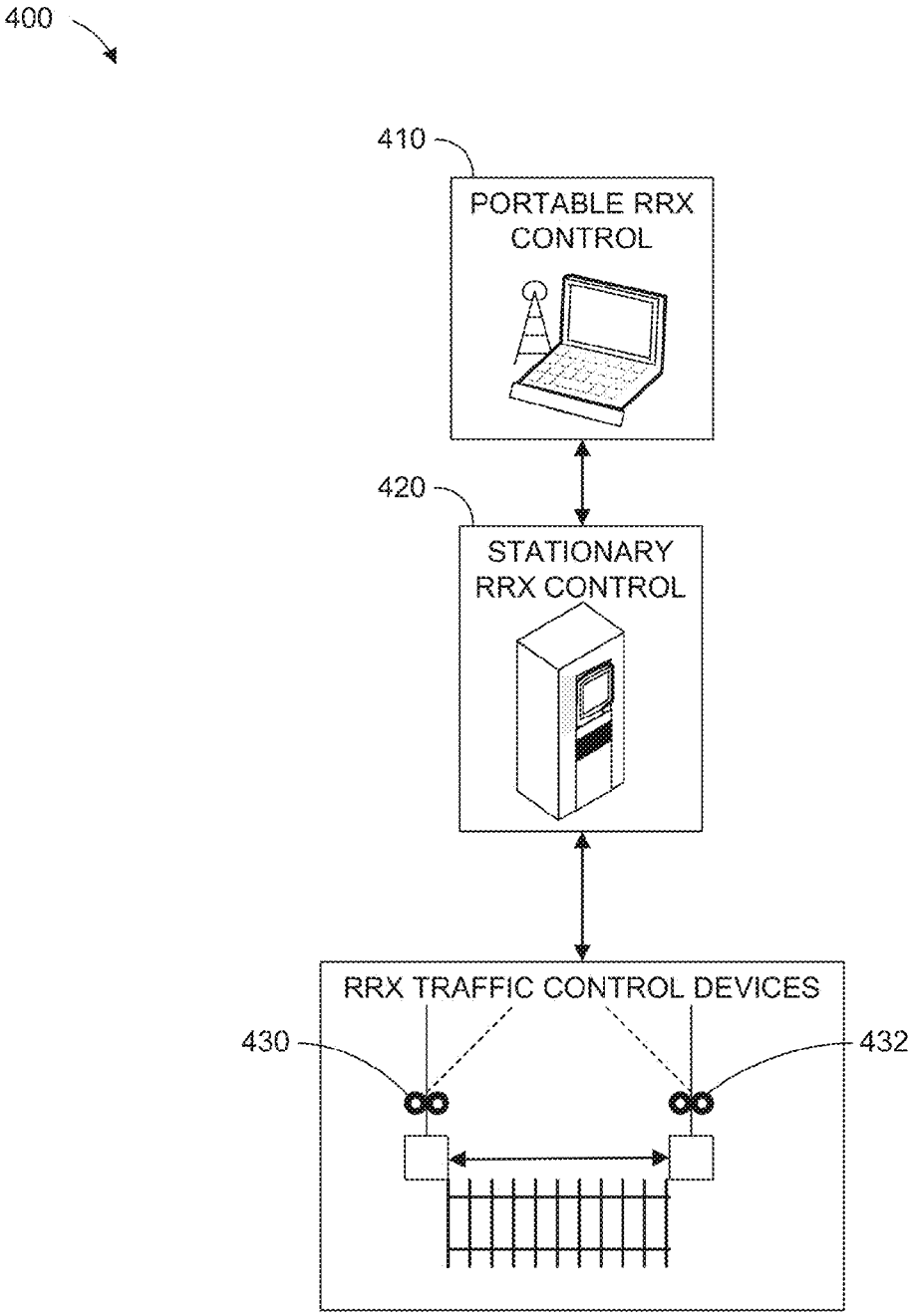
FIG. 4 illustrates a wireless railroad crossing gate network, according to one example embodiment.

FIG. 4 illustrates a wireless Railroad Crossing (RRX) traffic control network 400. An RRX traffic control network 400 may include a portable RRX traffic control system 410, at least one stationary RRX traffic control system 420, and RRX traffic control devices 430 and 432. For example, an RRX traffic control device 430 may include flashing red lights and gate arms. In an implementation, a portable RRX traffic control system 410 may use a wireless radio and antenna for wireless monitoring or control of a stationary RRX traffic control system 420. In an example, an stationary RRX traffic control system 420 may use a wireless radio and antenna for wireless monitoring or control of an RRX traffic control device 430. Using a wireless network, railroad service personnel could drive to within wireless range of a stationary RRX traffic control system 420, and use a slave RF device connected to or embedded within the portable RRX traffic control system 410 to interface with a stationary RRX traffic control system 420. The portable RRX traffic control system 410 may also be implemented as any other type of computing device (e.g., a tablet, mobile phone, etc.) that includes an embedded RF device or is connectable to a slave RF device.

Figure 5:
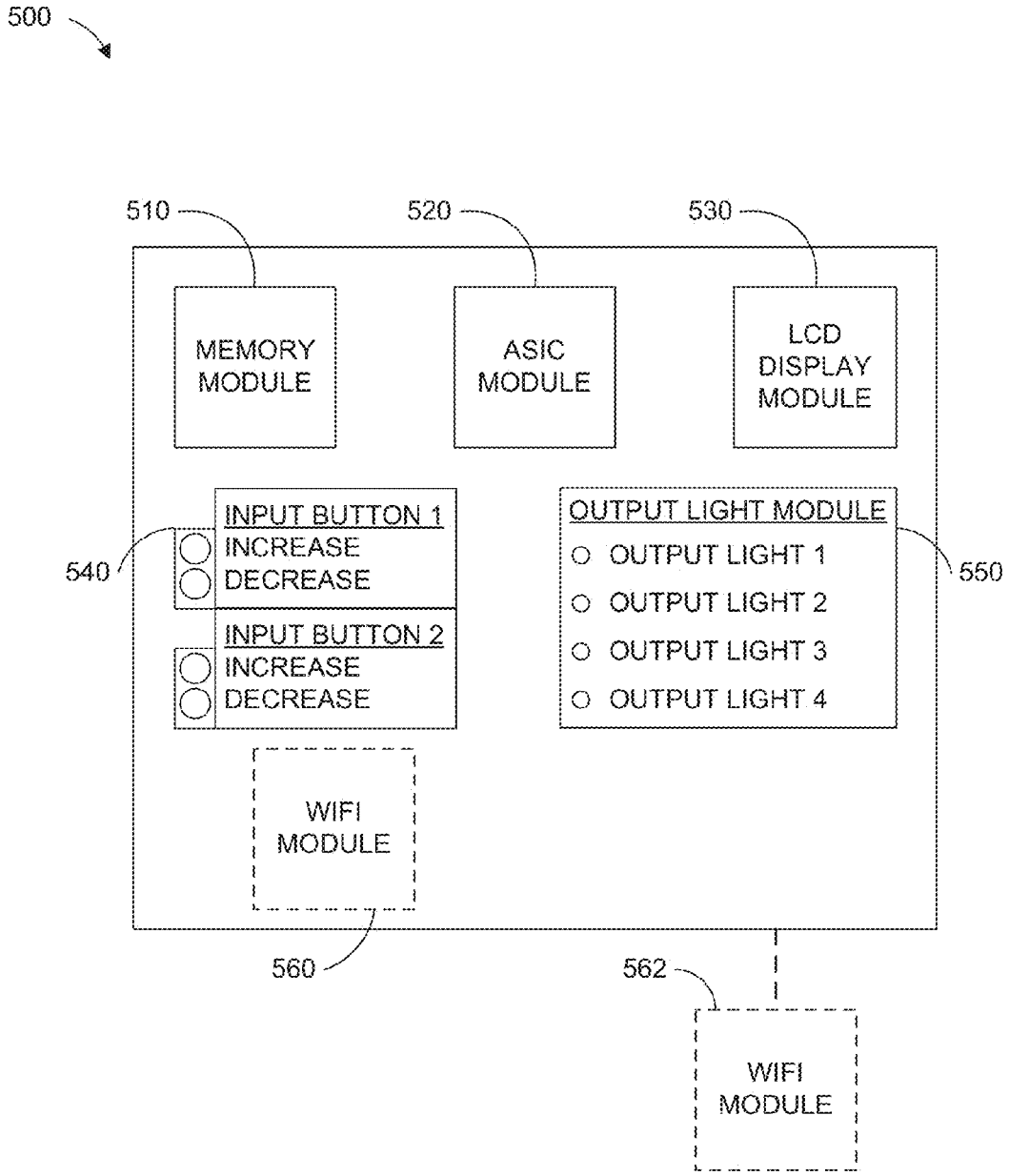
FIG. 5 illustrates hardware used to implement a Switch Heater Control interface, according to one example embodiment.

FIG. 5 illustrates an example SHC 500. An SHC 500 may include a memory module 510, an ASIC module 520, an LCD display module 530, one or more input buttons 540, one or more output light modules 550, and at least one RF module 560 or 562. In an example, the memory module 510 may be a removable memory card, such as a micro-SD card. The LCD display module 530 may be a two-line display, such as the SHC interface two-line display 210. The input buttons 540 may be used to monitor or select various features of an SHC, such as mode buttons 232 may or value buttons 234. Output light modules 550 may indicate whether each step in the startup process has occurred, analogous to the SHC interface lights 220. The RF module 560 or 562 may enable wireless communication to and from the example SHC 500. The RF module may be either an integrated RF module 560 or an externally connected RF module 562.

Figure 6:
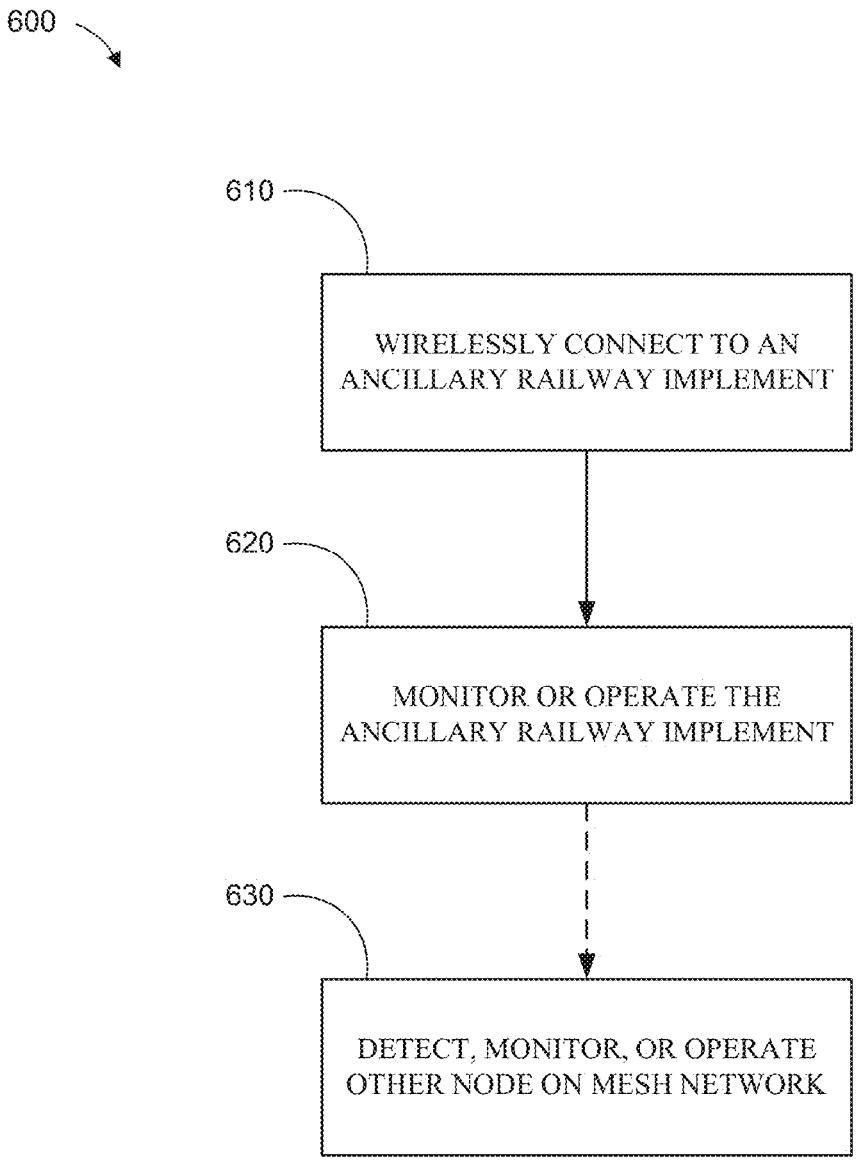
FIG. 6 illustrates a method for wireless control of a railroad switch heater network, according to one example embodiment.

FIG. 6 illustrates an example method 600 for local wireless network remote control of ancillary railway implements. The operations of method 600 may be performed in whole or part by one or more components described above with respect to FIGS. 1-5. At operation 610, railroad support personnel may connect to an ancillary railway implement. In an example, an ancillary railway implement may be an SHC. At operation 620, railroad support personnel may monitor or operate the ancillary railway implement. At operation 630, railroad support personnel may detect, monitor, or operate another node on the mesh network.

Although embodiments for a wireless railway implement network have been described in language specific to structural features and/or methods, it is to be understood that the invention is not necessarily limited to the specific features or methods described. Rather, the specific features and methods are disclosed as exemplary implementations for wireless network remote control of ancillary railway implements.

Figure 7:
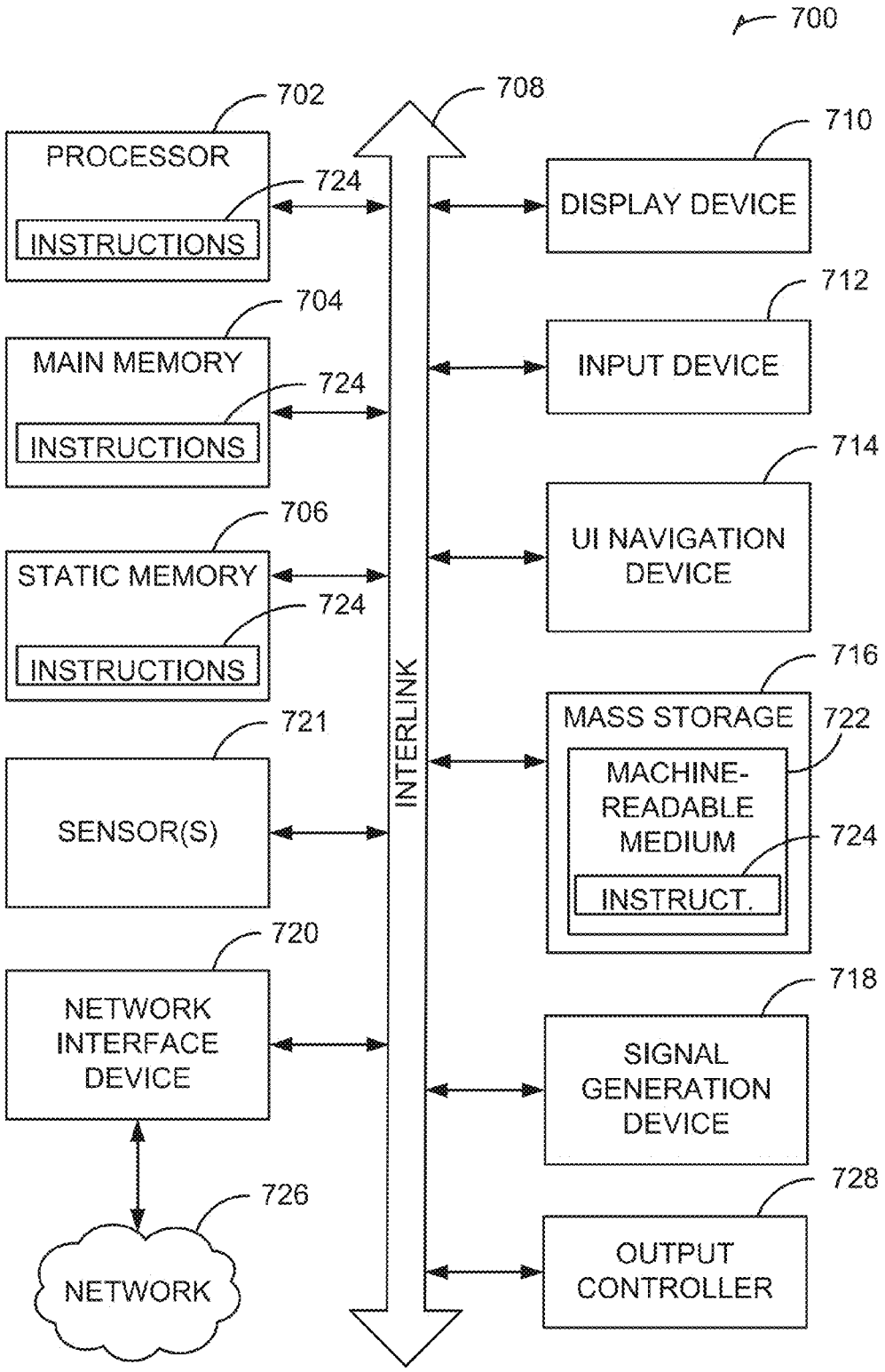
FIG. 7 is a block diagram illustrating an example of a machine upon which one or more embodiments may be implemented.

FIG. 7 illustrates a block diagram of an example machine 700 upon which any one or more of the techniques (e.g., methodologies) discussed herein may perform. In alternative embodiments, the machine 700 may operate as a standalone device or may be connected (e.g., networked) to other machines. In a networked deployment, the machine 700 may operate in the capacity of a server machine, a client machine, or both in server-client network environments. In an example, the machine 700 may act as a peer machine in peer-to-peer (P2P) (or other distributed) network environment. The machine 700 may be a personal computer (PC), a tablet PC, a set-top box (STB), a Personal Digital Assistant (PDA), a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

Examples, as described herein, may include, or may operate on, logic or a number of components, modules, or mechanisms. Modules are tangible entities (e.g., hardware) capable of performing specified operations and may be configured or arranged in a certain manner. In an example, circuits may be arranged (e.g., internally or with respect to external entities such as other circuits) in a specified manner as a module. In an example, the whole or part of one or more computer systems (e.g., a standalone, client or server computer system) or one or more hardware processors may be configured by firmware or software (e.g., instructions, an application portion, or an application) as a module that operates to perform specified operations. In an example, the software may reside on a machine readable medium. In an example, the software, when executed by the underlying hardware of the module, causes the hardware to perform the specified operations.

Accordingly, the term "module" is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comprise a general-purpose hardware processor configured using software, the general-purpose hardware processor may be configured as respective different modules at different times. Software may accordingly configure a hardware processor, for example, to constitute a particular module at one instance of time and to constitute a different module at a different instance of time.

Machine (e.g., computer system) 700 may include a hardware processor 702 (e.g., a central processing unit (CPU), a graphics processing unit (GPU), a hardware processor core, or any combination thereof), a main memory 704 and a static memory 706, some or all of which may communicate with each other via an interlink (e.g., bus) 708. The machine 700 may further include a display unit 710, an alphanumeric input device 712 (e.g., a keyboard), and a user interface (UI) navigation device 714 (e.g., a mouse). In an example, the display unit 710, input device 712 and UI navigation device 714 may be a touch screen display. The machine 700 may additionally include a storage device (e.g., drive unit) 716, a signal generation device 718 (e.g., a speaker), a network interface device 720, and one or more sensors 721, such as a global positioning system (GPS) sensor, compass, accelerometer, or other sensor. The machine 700 may include an output controller 728, such as a serial (e.g., universal serial bus (USB), parallel, or other wired or wireless (e g , infrared (IR)) connection to communicate or control one or more peripheral devices (e.g., a printer, card reader, etc.).

The storage device 716 may include a machine readable medium 722 on which is stored one or more sets of data structures or instructions 724 (e.g., software) embodying or utilized by any one or more of the techniques or functions described herein. The instructions 724 may also reside, completely or at least partially, within the main memory 704, within static memory 706, or within the hardware processor 702 during execution thereof by the machine 700. In an example, one or any combination of the hardware processor 702, the main memory 704, the static memory 706, or the storage device 716 may constitute machine readable media.

While the machine readable medium 722 is illustrated as a single medium, the term "machine readable medium" may include a single medium or multiple media (e.g., a centralized or distributed database, and/or associated caches and servers) that arranged to store the one or more instructions 724.

The term "machine readable medium" may include any medium that is capable of storing, encoding, or carrying instructions for execution by the machine 700 and that cause the machine 700 to perform any one or more of the techniques of the present disclosure, or that is capable of storing, encoding or carrying data structures used by or associated with such instructions. Non-limiting machine readable medium examples may include solid-state memories and optical and magnetic media. In an example, a massed machine readable medium comprises a machine readable medium with a plurality of particles having resting mass. Specific examples of massed machine readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 724 may further be transmitted or received over a communications network 726 using a transmission medium via the network interface device 720 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, wireless data networks (e.g., Institute of Electrical and Electronics Engineers (IEEE) 802.11 family of standards known as Wi-Fi®, and IEEE 802.16 family of standards known as WiMax®), and peer-to-peer (P2P) networks, among others. In an example, the network interface device 720 may include one or more physical jacks (e.g., Ethernet, coaxial, or phone jacks) or one or more antennas to connect to the communications network 726. In an example, the network interface device 720 may include a plurality of antennas to communicate wirelessly using at least one of single-input multiple-output (SIMO), multiple-input multiple-output (MIMO), or multiple-input single-output (MISO) techniques. The term "transmission medium" shall be taken to include any intangible medium that is capable of storing, encoding, or carrying instructions for execution by the machine 700, and includes digital or analog communications signals or other intangible medium to facilitate communication of such software.

In example 1, a method includes connecting, using a portable computing module operably coupled to a wireless module, to an ancillary railway implement; and operating, using the portable computing module, the ancillary railway implement.

Example 2 includes the method of example 1, wherein the ancillary railway implement is a railroad Switch Heater Control (SHC) module.

Example 3 includes the method of example 1, further including connecting, using a portable computing module through the ancillary railway implement, to one or more nodes.

Example 4 includes the method of any of examples 1-3, wherein the one or more nodes are secondary ancillary railway implements with wireless communication functionality, and wherein the wireless communication functionality is coupled to or embedded within the node control circuitry.

Example 5 includes the method of example 1, further including operating, using the portable computing module, the one or more nodes.

Example 6 includes the method of example 1, further including receiving a plurality of railway implement status information.

Example 7 includes the method of example 1, further including displaying at least a portion of the plurality of railway implement status information.

In example 8, a system includes a portable computing module; and an ancillary railway implement wirelessly connected to the portable computing module to enable an operator of the portable computing module to control the ancillary railway implement.

Example 9 includes the method of example 8, wherein the ancillary railway implement is a railroad Switch Heater Control (SHC) device.

Example 10 includes the system of example 8, further including a central server wirelessly connected to the portable computing module, the central server including a central license server and a central database.

Example 11 includes the system of example 8, the portable computing module including a portable computing database.

Example 12 includes the system of example 8, further including a primary ancillary railway implement wirelessly connected to the portable computing module.

Example 13 includes the system of example 8, further including one or more secondary railway implements wirelessly connected through the primary ancillary railway implement to the portable computing module.

In example 14, a computer-readable medium comprises instructions that, when executed by a machine, cause the machine to connect, using a portable computing module operably coupled to a wireless module, to an ancillary railway implement; and operate, using the portable computing module, the ancillary railway implement.

Example 15 includes the computer-readable medium of example 14, wherein the ancillary railway implement is a railroad Switch Heater Control (SHC) module.

Example 16 includes the computer-readable medium of example 14, the instructions further causing the machine to connect, using a portable computing module through the ancillary railway implement is communicatively coupled, to one or more nodes.

Example 17 includes the computer-readable medium of any of examples 14-16, wherein the one or more nodes are secondary ancillary railway implements with wireless communication functionality; and the wireless communication functionality is coupled to or embedded within the node control circuitry.

Example 18 includes the computer-readable medium of example 14, the instructions further causing the machine to operate, using the portable computing module, the one or more nodes.

Example includes the computer-readable medium of example 14, the instructions further causing the machine to receive a plurality of railway implement status information.

Example includes the computer-readable medium of example 14, the instructions further causing the machine to display at least a portion of the plurality of railway implement status information.

The above detailed description includes references to the accompanying drawings, which form a part of the detailed description. The drawings show, by way of illustration, specific embodiments in that may be practiced. These embodiments are also referred to herein as "examples." Such examples may include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended; that is, a system, device, article, or process that includes elements in addition to those listed after such a term in a claim are still deemed to fall within the scope of that claim. Moreover, in the following claims, the terms "first," "second," "third," and so forth are used merely as labels, and are not intended to impose numerical requirements on their objects.

The above description is intended to be illustrative and not restrictive. For example, the above-described examples (or one or more aspects thereof) may be used in combination with each other. Other embodiments may be used, such as by one of ordinary skill in the art upon reviewing the above description. The Abstract is to allow the reader to ascertain quickly the nature of the technical disclosure, for example, to comply with 37 C.F.R. §1.72(b) in the United States of America. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the embodiments should be determined with reference to the appended claims, along with the full scope of equivalents to which such claims are entitled.

What is claimed is:

1. A method comprising:

positioning a portable computing module within a local wireless network range of a first node on a mesh network, the first node associated with a first ancillary railway implement;

receiving a license from a license server, wherein the license allows or denies an application executed on the portable computing module from operating the first ancillary railway implement and allows the first ancillary railway implement to be used as a node to relay a command to a second ancillary railway implement;

connecting, using the application executed on the portable computing module operably coupled to a local wireless network module, to the first node associated with the first ancillary railway implement; and performing, using the application executed on the portable computing module, certain operations on the second ancillary railway implement, the certain operations on the ancillaly railway implement defined by the license.

2. The method of claim 1, wherein the second ancillary railway implement is a railroad Switch Heater Control (SHC) module.

3. The method of claim 1, wherein the first and second ancillary railway implements include wireless communication functionality, and wherein the wireless communication functionality is coupled to or embedded within a node control circuitry within the first and second ancillary railway implements.

4. The method of claim 1, further including receiving a plurality of railway implement status information.

5. The method of claim 1, further including displaying at least a portion of the plurality of railway implement status information.

6. A system comprising:

a portable computing module; and a first node on a mesh network, the first node associated with a first ancillary railway implement, the first node wirelessly connected to the portable computing module via a local wireless network to enable an application executed on the portable computing module to receive a verified license, the verified license allowing or denying the application executed on the portable computing module from operating the first ancillary railway implement and allowing the first ancillary railway implement to be used as a node to relay a command to a second ancillary railway implement, the certain operations on the ancillary railway implement defined by the license.

7. The method of claim 6, wherein the second ancillary railway implement is a railroad Switch Heater Control (SHC) device.

8. The system of claim 6, further including a central server wirelessly connected to the portable computing module, the central server including a central license server and a central database, wherein the central license server sends the verified license to the portable computing module.

9. The system of claim 6, the portable computing module including a portable computing database.

10. A non-transitory computer-readable medium comprising instructions that, when executed by a machine, cause the machine to:

receive a license from a license server, wherein the license allows or denies an application executed on the portable computing module from operating a first ancillary railway implement and allows the first ancillary railway implement to be used as a first node to relay a command to a second node within a mesh network, the second node associated with a second ancillary railway implement;

connect, using the application executed on the portable computing module operably coupled to a local wireless network module, to the first node associated with the first ancillary railway implement; and perform, using the application executed on the portable computing module, certain operations on the second ancillary railway implement, the certain operations on the ancillary railway implement defined by the license.

11. The non-transitory computer-readable medium of claim 10, wherein the second ancillary railway implement is a railroad Switch Heater Control (SHC) module.

12. The non-transitory computer-readable medium of claim 10, wherein:

the first and second ancillary railway implements include wireless communication functionality; and the wireless communication functionality is coupled to or embedded within a node control circuitry within the first and second ancillary railway implements.

13. The non-transitory computer-readable medium of claim 10, the instructions further causing the machine to receive a plurality of railway implement status information.

14. The non-transitory computer-readable medium of claim 10, the instructions further causing the application executed on the portable computing module to display at least a poliion of the plurality of railway implement status information.

* * * * *